US009765932B2

(12) United States Patent
Rado

(10) Patent No.: US 9,765,932 B2
(45) Date of Patent: Sep. 19, 2017

(54) BASE MANIFOLD AND SYSTEM FOR FILLING CONTAINERS WITH GAS

(71) Applicant: Scott Technologies, Inc., Boca Raton, FL (US)

(72) Inventor: Gordon E. Rado, Waxhaw, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 76 days.

(21) Appl. No.: 14/852,882

(22) Filed: Sep. 14, 2015

(65) Prior Publication Data

US 2015/0377417 A1 Dec. 31, 2015

Related U.S. Application Data

(63) Continuation of application No. PCT/US2014/023981, filed on Mar. 12, 2014.

(Continued)

(51) Int. Cl.

| | |
|---|---|
| ***F17C 5/06*** | (2006.01) |
| ***F17C 7/00*** | (2006.01) |
| ***F17C 13/04*** | (2006.01) |

(52) U.S. Cl.

CPC ..... *F17C 5/06* (2013.01); *F17C 7/00* (2013.01); *F17C 13/04* (2013.01);

(Continued)

(58) Field of Classification Search

CPC .... F17C 5/06; F17C 13/04; F17C 7/00; F17C 2270/01; F17C 2270/025;

(Continued)

(56) References Cited

U.S. PATENT DOCUMENTS 5,088,436 A * 2/1992 Stritmatter ..... F17C 5/02 137/263
7,615,031 B2 * 11/2009 Bonnette ..... A61M 25/1018 604/99.01

(Continued)

FOREIGN PATENT DOCUMENTS

CN 1052720 A 7/1991
CN 103390761 A 11/2013

(Continued)

OTHER PUBLICATIONS

Notification of Transmittal of the International Search Report and the Written Opinion of the International Searching Authority, or the Declaration, International Search Report and Written Opinion of the International Searching Authority, dated Jun. 19, 2014, for International Application Serial No. PCT/US2014/023981, International Filing Date Mar. 12, 2014, consisting of 7-pages.

(Continued)

*Primary Examiner* — Nicolas A Arnett

(74) *Attorney, Agent, or Firm* — Christopher & Weisberg, P.A.

(57) ABSTRACT

Gas-filling system including a base manifold having a flow-control component and a manifold body that is operably coupled to the flow-control component. The manifold body includes a fill port and first and second supply ports that open to an exterior of the base manifold. The first and second supply ports are in fluid communication with a common passage within the manifold body such that the gas flowing through the first supply port or through the second supply port flows through the common passage to the fill port. The fill port is configured to be in fluid communication with a container. The gas-filling system also includes an accessory module removably coupled to the manifold body.

(Continued)

The accessory module is connected to the first supply port and has an inlet port.

10 Claims, 7 Drawing Sheets

Related U.S. Application Data

(60) Provisional application No. 61/779,204, filed on Mar. 13, 2013.

(52) U.S. Cl.
CPC ..... *F17C 2205/0146* (2013.01); *F17C 2205/0153* (2013.01); *F17C 2221/011* (2013.01); *F17C 2221/013* (2013.01); *F17C 2221/014* (2013.01); *F17C 2221/031* (2013.01); *F17C 2221/033* (2013.01); *F17C 2223/0123* (2013.01); *F17C 2223/035* (2013.01); *F17C 2225/0123* (2013.01); *F17C 2225/035* (2013.01); *F17C 2270/01* (2013.01); *F17C 2270/025* (2013.01); *F17C 2270/0745* (2013.01); *F17C 2270/0754* (2013.01); *F17C 2270/0781* (2013.01)

(58) Field of Classification Search
CPC ..... F17C 2270/0745; F17C 2270/0754; F17C 2270/0781; F17C 2205/0153; F17C 2205/0146; F17C 2225/035; F17C 2225/0123; F17C 2221/031; F17C 2221/033; F17C 2221/013; F17C 2221/011; F17C 2221/014; F17C 2223/0123; F17C 2223/035
See application file for complete search history.

(56) References Cited

U.S. PATENT DOCUMENTS

| | | | | |
|---|---|---|---|---|
| 7,905,252 | B2 * | 3/2011 | Neumann | F17C 5/06 137/512.4 |
| 8,464,818 | B2 * | 6/2013 | Uchimura | H01M 8/04089 180/69.4 |
| 9,310,024 | B2 * | 4/2016 | Plummer | F17C 13/003 |
| 2007/0215209 | A1 * | 9/2007 | Street | F17C 5/06 137/263 |
| 2010/0051109 | A1 | 3/2010 | Meier | |
| 2011/0174562 | A1 * | 7/2011 | Uchimura | H01M 8/04089 180/69.4 |

FOREIGN PATENT DOCUMENTS

| | | | |
|---|---|---|---|
| CN | 103930708 | A | 7/2014 |
| DE | 10 2009 013 542 | A1 | 9/2010 |
| SU | 684246 | A1 | 9/1979 |
| SU | 1153164 | A1 | 4/1985 |
| SU | 558131 | A1 | 5/1997 |
| WO | 2007108876 | A2 | 9/2007 |
| WO | 2008157242 | A2 | 12/2008 |
| WO | 2010/030921 | A1 | 3/2010 |

OTHER PUBLICATIONS

State Intellectual Property Office of the People's Republic of China, Notification of the First Office Action (PCT Application in the National Phase), dated Oct. 10, 2016, consisting of 10-pages.

Chinese Notification of the Second Office Action and English translation dated Jul. 3, 2017, issued in corresponding Chinese Application Serial No. 201480024350.X, filed Oct. 29, 2015, consisting of 13 pages.

* cited by examiner

BASE MANIFOLD AND SYSTEM FOR FILLING CONTAINERS WITH GAS

CROSS-REFERENCE TO RELATED APPLICATIONS

This application is a continuation of International Patent Application No. PCT/US2014/023981 filed Mar. 12, 2014, which claims the benefit of U.S. Provisional Patent Application No. 61/779,204 filed Mar. 13, 2013, the contents of both of which are incorporated herein by reference.

FIELD OF THE DISCLOSURE

The subject matter described and/or illustrated herein generally relates to systems and components for filling containers with gas and, more particularly, filling the containers using fill or charge stations.

BACKGROUND OF THE DISCLOSURE

Fill or charge stations may be used to fill depleted canisters with compressed gas. Numerous types of canisters exist for storing compressed gas, such as anesthesia, air, oxygen, carbon dioxide, nitrogen, compressed natural gas (CNG), and the like. For example, self-contained breathing apparatuses (SCBAs) include one or more canisters (or cylinders) and may be used in a variety of environments, such as firefighting, medicine, recreational underwater diving, and the like. Various fill stations exist for filling the canisters with the appropriate type of gas and an amount/pressure of the gas.

Fill stations may include a control system, a station housing that is configured to receive one or more of the canisters, and pneumatic components (e.g., valves, tubes, pipes, fittings, etc.) that may be stored within or may be attached to the station housing. The control system has user-activated elements for managing the fill station. Although existing fill stations are effective in supplying compressed gas to the canisters, such fill stations may have some drawbacks. For instance, assembling and maintaining the fill stations may require a substantial amount of labor and costs. When the fill station is constructed, numerous pneumatic components are interconnected through threaded fittings and/or strung together with tubing. Assembling the many pneumatic components can be time consuming. Moreover, multiple connections increase the likelihood that a leak will develop in the fill station. If a leak is detected, the operator may be required to disassemble the fill station and remove any defective components. Frequently, the defective components and/or other components from the disassembling cannot be re-used.

In addition to the above drawbacks, other problems may exist in conventional fill stations. The control system typically includes numerous user-activated elements, such as knobs, switches, buttons, and the like, that may be used to control various functions offered by the fill station. Some functions offered by fill stations include auto-cascade filling, manual cascade filling, bulk storage, and dual pressures. Different fill stations, however, may have different control system configurations and it may not be readily apparent to a new operator how to manage the fill station.

SUMMARY OF THE DISCLOSURE

In an embodiment, a gas-filling system is provided. The gas-filling system includes a system housing having a receiving dock that is configured to receive a container for filling the container with a gas. The gas-filling system also includes a base manifold coupled to the system housing. The base manifold includes a flow-control component and a manifold body that is operably coupled to the flow-control component. The manifold body includes a fill port and first and second supply ports that open to an exterior of the base manifold. The first and second supply ports are in fluid communication with a common passage within the manifold body such that the gas flowing through the first supply port or through the second supply port flows through the common passage to the fill port. The flow-control component controls flow of the gas through the common passage. The fill port is configured to be in fluid communication with the container in the receiving dock. The gas-filling system also includes an accessory module removably coupled to the manifold body. The accessory module is connected to the first supply port and has an inlet port. The inlet port is in fluid communication with the first supply port such that the gas flowing through the inlet port flows to the first supply port.

In certain embodiments, the manifold body may include first and second body sides that face in different directions. The first body side includes the first supply port and the second body side includes the second supply port. Optionally, the manifold body may include a front side having a user-activated element for manually controlling the flow of the gas. The front side and the first side may face in opposite directions. The second side may face in a direction that is perpendicular to the directions faced by the front side and the first side. Also optionally, the first and second sides have respective side surfaces. The first and second supply ports may be substantially flush with the side surfaces of the first and second body sides, respectively.

In certain embodiments, the manifold body includes a planar side surface. The first supply port may be substantially flush with the side surface.

In certain embodiments, the flow-control component is a first flow-control component, and the gas-filling system includes a second flow-control component that controls flow of the gas through the common passage. Optionally, the first and second flow-control components are a pressure regulator and a control valve, respectively.

In certain embodiments, the gas-filling system may also include a sealing component that is secured to the base manifold. The sealing component has a component surface that blocks flow of gas through the second supply port.

In certain embodiments, the accessory module may be configured to control flow of the gas therethrough. The accessory module may include an auto-cascade module, a manual cascade module, or a bulk storage module.

Optionally, the base manifold is configured to control the gas when having a pressure in excess of 5000 pounds per square inch (psi).

In an embodiment, a base manifold is provided that includes a manifold body having a fill port and first and second supply ports that open to an exterior of the manifold body. The first and second supply ports are configured to receive gas for filling a container that is in fluid communication with the fill port. The first and second supply ports are in fluid communication with a common passage within the manifold body such that the gas flowing through the first supply port or through the second supply port flows through the common passage to the fill port. The base manifold may also include a flow-control component operably coupled to the manifold body. The flow-control component controls flow of the gas through the common passage.

In certain embodiments, the manifold body may include first and second body sides that face in different directions. The first body side includes the first supply port and the second body side includes the second supply port. Optionally, the manifold body may include a front side having a user-activated element for manually controlling the flow of the gas. The front side and the first side may face in opposite directions. The second side may face in a direction that is perpendicular to the directions faced by the front side and the first side. Also optionally, the first and second sides have respective side surfaces. The first and second supply ports may be substantially flush with the side surfaces of the first and second body sides, respectively.

In certain embodiments, the manifold body includes a planar side surface. The first supply port may be substantially flush with the side surface.

In certain embodiments, the flow-control component is a first flow-control component, and the gas-filling system includes a second flow-control component that controls flow of the gas through the common passage. Optionally, the first and second flow-control components are a pressure regulator and a control valve, respectively.

Optionally, the base manifold is configured to control the gas when having a pressure in excess of 5000 pounds per square inch (psi).

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" or "an exemplary embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
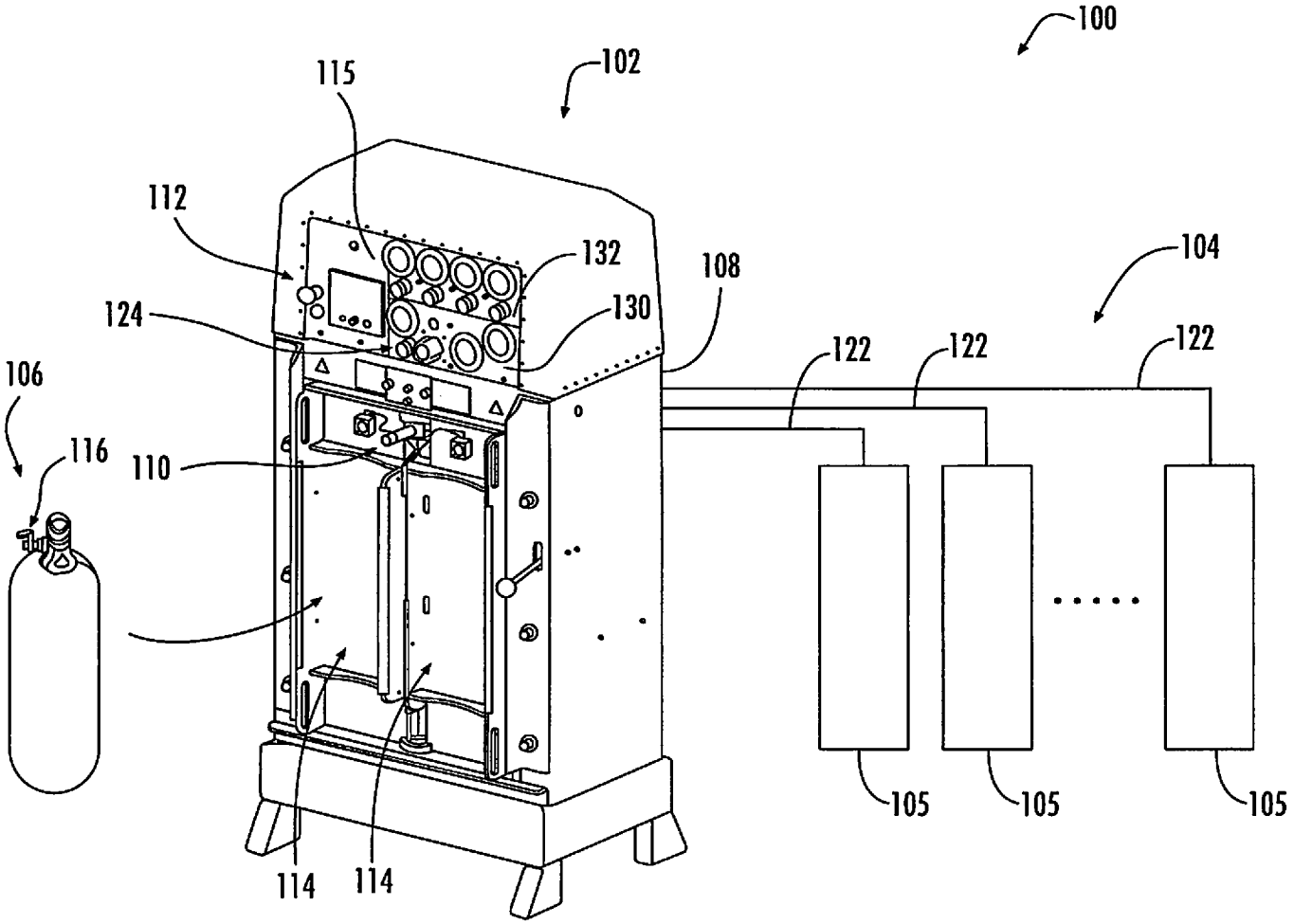
FIG. 1 is a perspective view of a gas-filling system in accordance with an embodiment that is configured to supply gas to one or more containers.

FIG. 1 is a perspective view of a gas-filling system 100. The gas-filling system 100 includes a charge station 102 and a gas supply 104. The charge station 102 is configured to fill a canister 106 with a gas from the gas supply 104. The gas may be any gas, such as, ambient air, oxygen, nitrox, tirmix, heliox, heliair, hydreliox, hydrox, neox, a combination of the above, and the like. In particular embodiments, the gas is breathing air that may be used by, for example, emergency personnel (e.g., firefighters) or undersea divers. The canister 106 may be any type of container that is capable of holding compressed or pressurized gas, such as, but not limited to, a gas cylinder for a self-contained breathing apparatus (SCBA), a space suit, medical equipment, a self-contained underwater breathing apparatus (SCUBA), and/or the like. In FIG. 1, the canister 106 has a cylindrical shape and is sized to be carried by an individual. In other embodiments, the canister 106 may have another shape and may be larger or smaller. In alternative embodiments, the gas-filling system 100 may supply air to other containers, such as storage tanks.

The charge station 102 includes a system housing 108, one or more filling ports 110, and a control system 112. The system housing 108 includes one or more receiving docks 114 that receive the canister 106. Each filling port 110 is positioned relative to one of the receiving docks 114 so that the filling port 110 may be fluidly connected to the corresponding canister 106 when the canister 106 is disposed within the corresponding receiving dock 114. The filling ports 110 are fluidly connected to the gas supply 104 through a pneumatic circuit, which may include a plurality of interconnected passages that are in fluid communication with the gas supply 104. In the illustrated embodiment, the gas supply 104 includes a plurality of storage containers 105. Each storage container 105 may represent a single container (e.g., canister, cylinder, tank, and the like) or may represent a bank of such containers. For example, each bank may include four large canisters. The storage containers 105 are typically larger than the canisters 106. As shown, any number of storage containers 105 may be fluidly connected to the charge station 102. In the illustrated embodiment, the storage containers 105 are connected to the charge station 102 through multiple lines 122. In other embodiments, the storage containers 105 may be fluidly connected in one or more shared lines.

Each filling port 110 is configured to be fluidly connected to an inlet 116 of the canister 106 for filling the canister 106 with gas from the gas supply 104. Specifically, when a canister 106 is desired to be filled, the canister 106 is mounted onto one of the receiving docks 114 and the inlet 116 of the canister 106 is fluidly connected to the filling port 110. Although two filling ports 110 and two receiving docks 19 are shown, the charge station 102 may include any number of filling ports 110 and any number of receiving docks 114, for simultaneously filling any number of canisters 106. In the exemplary embodiment, the gas supply 104 is not part of the charge station 102. For example, the gas supply 104 may not be held by or in the system housing 108 of the charge station 102. Alternatively, the gas supply 104 may be part of the charge station 102.

The control system 112 controls filling of the canister 106 with gas from the gas supply 104. For instance, the control system 112 may regulate the flow of gas into the canister(s) 106. The control system 112 may include a control panel 115 that includes a plurality of user-activated elements 124, such as knobs, switches, levers, buttons, and the like. The user-activated elements 124 may be physical or tangible components capable of being touched and moved by an individual. In other embodiments, the user-activated elements 124 may be icons displayed on a touch-screen. The touch-screen may include the hardware and/or software for identifying when a user has contacted the touch-screen and identifying where the contact was made. Although not shown, the control system 112 may also include logic-based circuitry (e.g., processor) that is configured to automatically control some or all portions of the filling process and/or configured to receive instructions from the individual for controlling the filling process. The instructions may be provided by the individual by pressing or moving one of the user-activated elements 124. For example, the individual and/or the logic-based circuitry may activate the filling process, deactivate the filling process, select parameters of the filling process (such as, but not limited to, selecting a pressure to fill the canister 106 with and/or the like), and/or the like.

The control system 112 includes a plurality of stacked manifold modules 130 and 132. Each of the manifold modules 130, 132 is configured to receive gas and direct gas in a predetermined manner from one or more inlet ports to one or more outlet ports. In some cases, the manifold modules may control or manage the flow rate and/or combine one or more of the gases together as the gases flow through the corresponding manifold module.

In the illustrated embodiment, the manifold module 130 is a base manifold 130 and the manifold module 132 is an accessory module 132. The accessory module 132 and the base manifold 130 are removably coupled to each other. As used herein, the term "removably coupled" means that a first component may be readily separable from a second component without destroying either of the first and second components. Components are readily separable when the two components may be separated from each other without undue effort or a significant amount of time spent in separating the two components. For example, the components may be coupled to one another using fasteners, such as screws, latches, buckles, and the like, where a technician may uncouple the two components using a tool or the technician's hands. In addition, removably coupled components may be coupled without a fastener, such as by forming an interference or snap fit with respect to each other. It is understood that a combination of different methods may be used to removably couple to components. For example, the two components may initially be coupled through an interference fit and then a latch or other fastener may further secure the components together.

The base manifold 130 and the accessory module 132 may have a stacked relationship. In the illustrated embodiment, the base and accessory modules 130, 132 are vertically stacked such that gravity pulls the accessory module 132 toward the base manifold 130. In other embodiments, the base manifold 130 and the accessory module 132 may be stacked such that the base manifold 130 is above the accessory module 132 or such that neither is stacked on top of the other. In such embodiments in which neither is stacked on top of the other, the base manifold 130 and the accessory module 132 may be horizontally stacked and removably coupled to each other side-by-side. In an exemplary embodiment, the base manifold 130 is removably coupled to a remainder of the charge station 102. For example, the base manifold 130 may be removably coupled to the system housing 108.

FIG. 1 illustrates only one example of a gas-filling system in which embodiments set forth herein may be implemented. It should be understood that embodiments set forth herein may be used with other systems and apparatuses. Examples include filling systems, apparatuses, components, assemblies, and features that are described in U.S. Pat. No. 7,415,995 and U.S. Patent Publication No. 2010/0065146, each of which is incorporated herein by reference in its entirety. In some embodiments, the gas-filling system 100 may be similar to the RevolveAir™ Charge Station and related product line that is available through Scott Safety.

The gas-filling system 100 may include other components that are not shown, such as other compressors or air-purification systems. Embodiments may achieve requirements established by government regulations or other standards. For example, the compressed gas may be Grade D or higher, as specified in the Compressed Gas Association publication CGA G-7.1 entitled *Commodity Specification for Air*, available from the Compressed Gas Association, Inc., 1725 Jefferson Davis Hwy., Suite 1004, Arlington, Va. 22202. In addition to meeting the requirements of Grade D or higher, the compress may be dry to a dew point of −65° F. (−54° C.) or less.

Figure 2:
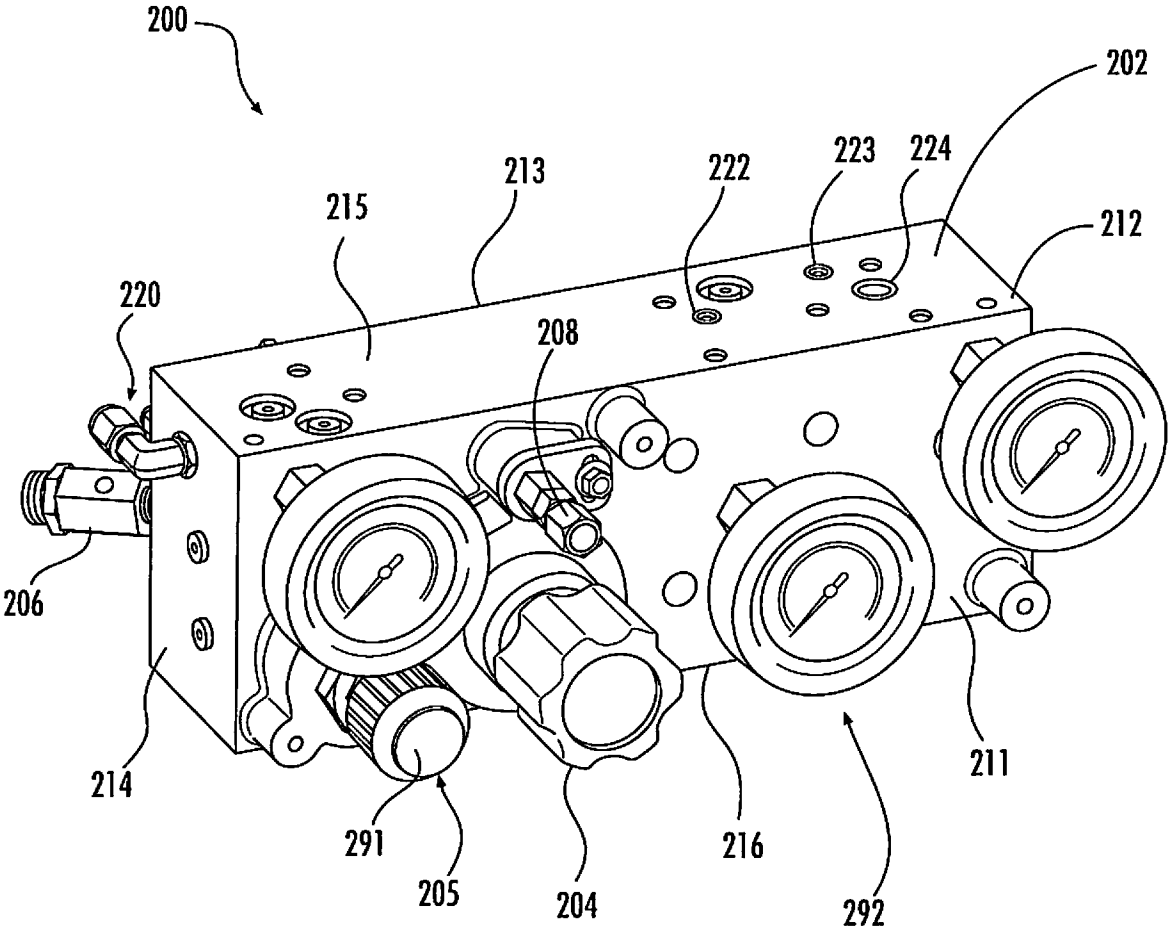
FIG. 2 is an isolated perspective view of a base manifold formed in accordance with an embodiment that may be used with the gas-filling system of FIG. 1.
Figure 3:
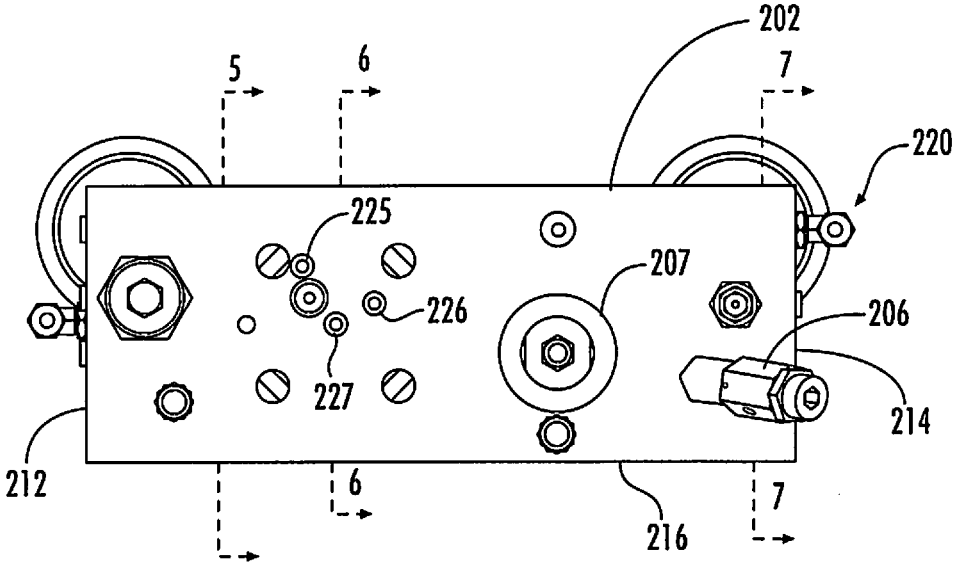
FIG. 3 is a rear view of the base manifold of FIG. 2.
Figure 4:
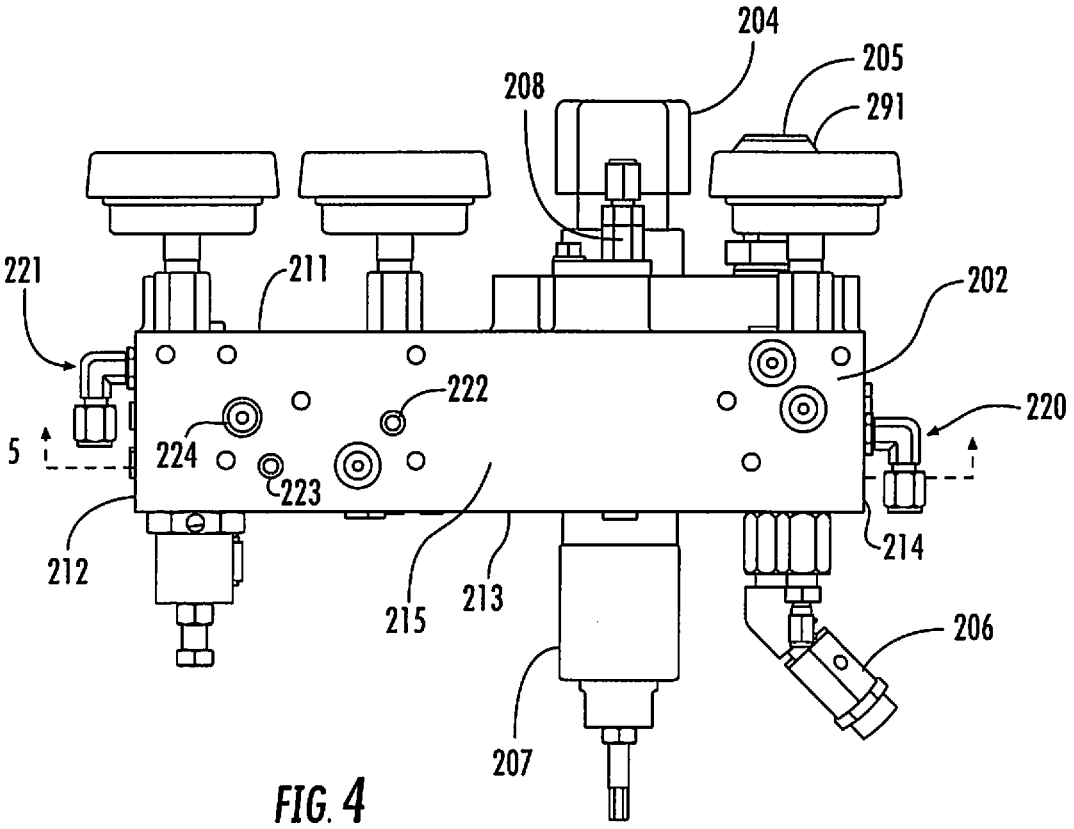
FIG. 4 is a top plan view of the base manifold of FIG. 2.

FIGS. 2-4 show different views of a base manifold 200. More specifically, FIG. 2 is an isolated perspective view of a base manifold 200, FIG. 2 is a back end view of the base manifold 200, and FIG. 3 is a top-plan view of the base manifold 200. The base manifold 200 may be used as the base manifold 130 in FIG. 1. Alternatively, the base manifold 200 may be used with other gas-filling systems. The base manifold 200 is configured to be removably coupled to one or more accessory modules, such as the accessory modules 300, 330, 360 described with respect to FIGS. 6, 7, 8, respectively. Although the following describes one illustrated embodiment of the base manifold 200, it is understood that various elements/features may be added, various elements/features may be omitted, and/or various modifications to existing features may be made in other embodiments.

The base manifold 200 includes a manifold body 202 and a plurality of flow-control components 204-208 operably coupled to the manifold body 202. The manifold body 202 includes a plurality of passages, which are described in greater detail below, and a plurality of ports 220-228 that open to the exterior of the base manifold 200 or the manifold body 202. In other words, the ports 220-228 may be accessed from the exterior of the base manifold 200 or the manifold body 202. Each of the flow-control components 204-208 is configured to regulate or control, in some manner, the flow of gas through the manifold body 202. For example, each of the flow-control components 204-208 may be configured to change the flow rate and/or pressure of the gas within the manifold body 202. In the illustrated embodiment, the flow-control components 204-208 include a pressure regulator 204, a manual control valve 205, a relief valve 206, an automatic control valve 207, and an auxiliary regulator 208. In some cases, the flow-control components 204-208 may be operably coupled to a user-activated element. For example, the manual control valve 205 is operably coupled to a rotatable knob 291 that may be activated (e.g., rotated) by the operator. However, one or more of the flow-control components 204-208 may be modified or omitted in other embodiments and other flow-control components may be added in other embodiments. The flow-control components 204-208 may be operable at separate times or one or more of the flow-control components 204-208 may be operable concurrently. Unlike known gas-filling systems, the flow-control components 204-208 have are secured to the manifold body 202 and have fixed positions with respect to each other.

The manifold body 202 has a plurality of body sides 211-216, including a front body side 211, a back or rear body side 213, lateral body sides 212, 214, a top body side 215, and a bottom or mounting body side 216. The front body side 211 includes a control area 292 and is presented to a user or operator of the base manifold 200 or the gas-filling system (not shown). The control area 292 includes the user-activated elements (e.g., knobs), such as the knob 291, that are accessible by the user. The front and back body sides 211, 213 face in opposite directions. The bottom and top body sides 216, 215 face in opposite directions, and the lateral body sides 212, 214 face in opposite directions. In the illustrated embodiment, the manifold body 202 is shaped as a rectangular block. Alternatively, the manifold body 202 may have other shapes. For example, one or more of the sides 211-216 may have a curved contour. The manifold body 202 may also have additional or fewer sides than shown in FIG. 1. The bottom body side 216 is configured to be mounted onto a system housing, such as the system housing 108. Each of the body sides 212-216 includes at least one of the ports. More specifically, the lateral body side 214 includes a fill port 220. The fill port 220 is configured to be directly connected to a conduit (e.g., tube or pipe) that is in fluid communication with a canister, such as the canister 106 (FIG. 1). Accordingly, gas flowing through the fill port 220 is directed to the canister. Also shown, the lateral body side 212 includes a compressor port 221. The fill and compressor ports 220, 221 are illustrated as elbow connectors coupled to the manifold body 202, but other types of ports or connectors may be used.

The top body side 215 includes supply ports 222-224, and the back body side 213 includes supply ports 225-227. Each of the supply ports 222-224 may be in fluid communication with a supply passage 240 (shown in FIG. 5), and each of the supply ports 225-227 may be in fluid communication with a supply passage 242. The supply passages 240, 242, in turn, are in fluid communication with the fill port 220 through a common passage 244 (shown in FIG. 5). Accordingly, at least one of the supply ports 225-227 and at least one of the supply ports 222-224 are in fluid communication with the fill port 220 through the corresponding supply passage and through the common passage 244. As described in greater detail below, the supply passage 240 may be used to deliver the gas to the common passage 244 while the supply passage 242 is sealed or blocked. Alternatively, the supply passage 242 may be used to deliver the gas to the common passage 244 while the supply passage 240 is sealed or blocked. As such, the base manifold 200 may provide multiple passages to the common passage 244.

Figure 5:
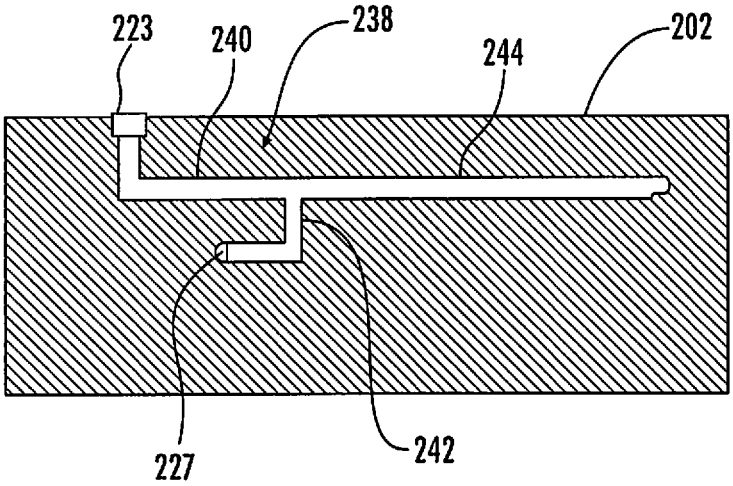
FIG. 5 illustrates a cross-section of the base manifold of FIG. 2 illustrating a common passage and supply passages of a pneumatic circuit.

In some embodiments, only one of the supply ports 222-224 provides a continuous line to the common passage 244 (FIG. 5). The other supply ports may be used to regulate or measure the connection between the supply ports 222-224 and the accessory module. For example, one or more of the supply ports 222-224 may include or form part of a check valve or reference valve that is used to measure and/or regulate flow of the gas through the other supply port. In the illustrated embodiment, the supply port 223 provides access to the supply passage 240 that directly connects to the common passage 244. In a similar manner, only one of the supply ports 225-227 may provide a continuous passage to the common passage 244. The other supply ports may be used to regulate or measure the connection between the supply ports 225-227 and the accessory module. In the illustrated embodiment, the supply port 227 provides access to the supply passage 242 that directly connects to the common passage 244.

The supply ports 222-227 may provide quick-connect type interfaces. For example, each of the supply ports 222-227 may be shaped to receive a projection (e.g., nozzle) and have an elastomer seal, such as an o-ring, that seals the connection when the projection is inserted into the corresponding supply port. For example, each of the accessory modules 300, 330, 360 may have nozzles that are configured to be inserted into one or more of the supply ports 222-227.

As shown in FIGS. 2-4, the body sides 211-216 include planar side surfaces. The planar side surfaces may be configured to engage or interface with side surfaces of the accessory modules. As such, the accessory modules may be horizontally or vertically stacked with respect to the base manifold 200. In particular embodiments, the supply ports 222-227 are flush with the corresponding side surfaces.

FIG. 5 is a cross-section of the manifold body 202 taken along the line 5-5 in FIG. 4 and illustrates a pneumatic circuit 238 including the supply passages 240, 242 and the common passage 244. For illustrative purposes, other passages and elements have been removed form the manifold body 202. Such passages may fluidly couple the common passage 244 and one or more of the flow-control components 204-208 (FIG. 2). As shown, the manifold body 202 has the supply passage 240 in fluid communication with the supply port 223 and the supply passage 242 in fluid communication with the supply port 227. Each of the supply ports 223, 227 is in fluid communication with the common passage 244. More specifically, gas entering the manifold body 202 through the supply port 223 flows through the supply passage 240 and into the common passage 244. Gas entering the manifold body 202 through the supply port 227 flows through the supply passage 242 and into the common passage 244. Gas flowing through the common passage 244 then flows through the fill port 220 (FIG. 2) and toward the canister.

Figure 6:
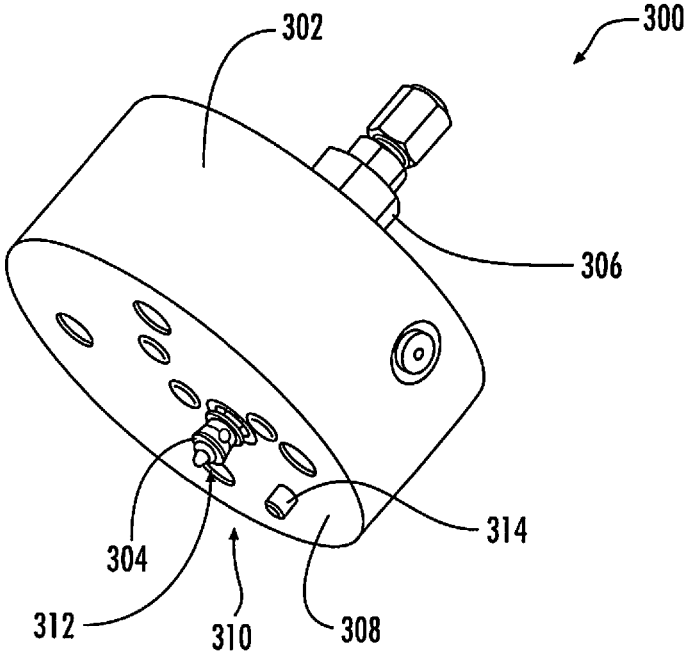
FIG. 6 is an isolated perspective view of an accessory module that may be used as a bulk storage module.
Figure 7:
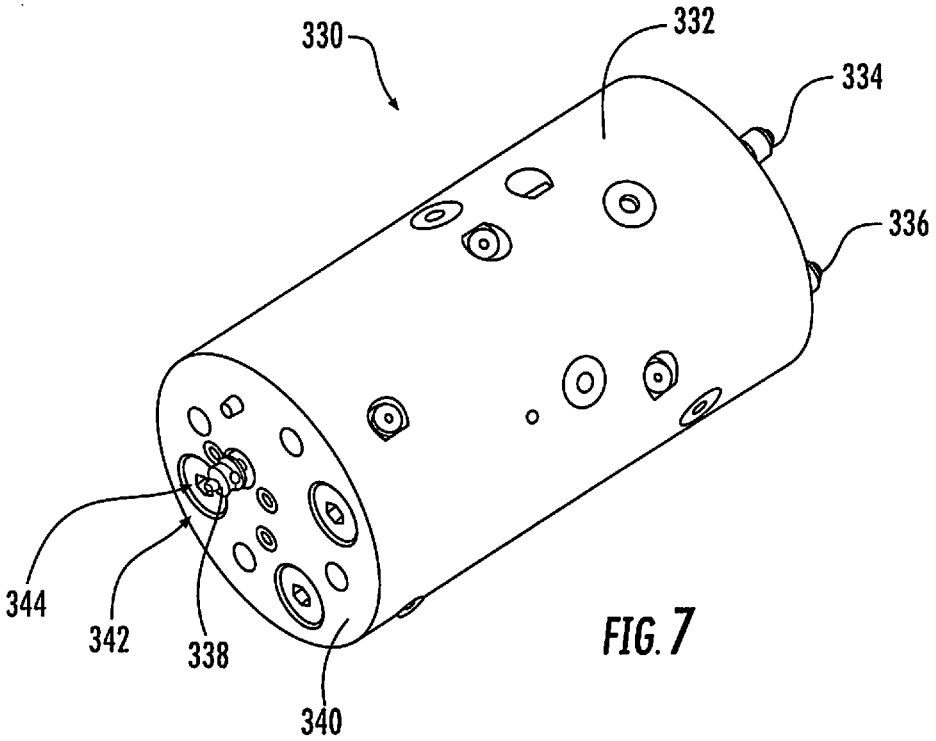
FIG. 7 is an isolated perspective view of an accessory module that may be used as an auto-cascade module.
Figure 8:
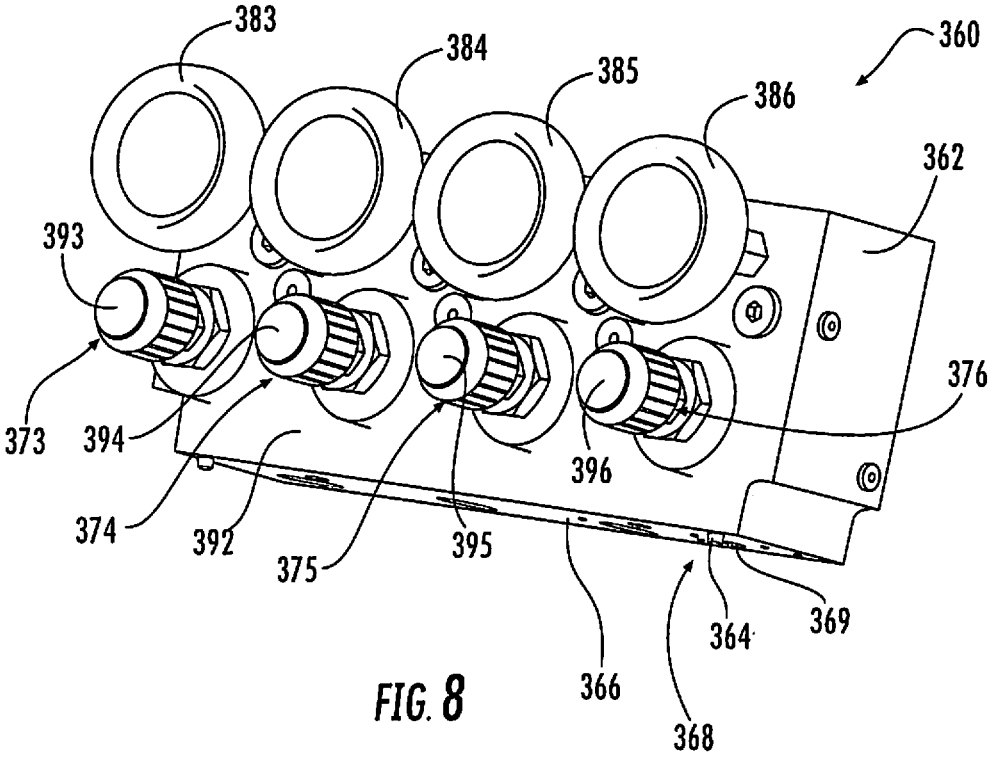
FIG. 8 is an isolated perspective view of an accessory module that may be used as a manual cascade module.

FIGS. 6-8 illustrate different accessory modules 300, 330, 360 that may be coupled to a base manifold, such as the base manifold 200. Each of the accessory modules 300, 330, 360 is capable of controlling the flow of gas through the corresponding accessory module. For example, the accessory module 300 shown in FIG. 6 is a bulk storage module 300. The bulk storage module 300 is configured to couple to a body side of the base manifold, such as the back body side 213. The bulk storage module 300 has a module body 302 that may include flow-control components therein, such as a valve (not shown). The module body 302 includes a base port 304 and a storage port 306 that are in fluid communication with each other through a passage (not shown) within the module body 302. The flow-control component (not shown) may be in fluid communication with the passage and, as such, capable of controlling the flow of gas through the module body 302.

The base port 304 is configured to connect to a supply port of the base manifold, such as the supply port 227 (FIG. 3). The storage port 306 is configured to fluidly connect to a gas supply, such as the gas supply 104. In some embodiments, the bulk storage module 300 is configured to permit bi-directional flow of gas through the module body 302. For example, when the gas-filling system (not shown), such as the gas-filling system 100, has a first pressure state or condition, the flow of gas may be directed from the gas supply through the storage port 306 and through the base port 304 into the base manifold. If the gas-filling system has a second pressure state or condition, the flow of gas may be directed from the base manifold through the base port 304 and through the storage port 306 into the gas supply.

As shown in FIG. 6, the module body 302 includes a body side 308 having a mating interface 310. The body side 308 is configured to directly engage the base manifold. The mating interface 310 includes the base port 304, which is illustrated as a nozzle 312. The nozzle 312 is configured to be inserted into the supply port of the base manifold. The mating interface 310 may also include other structural features, such as the boss member 314 that may also be inserted into an opening along the base manifold. The boss member 314 may be used to properly align the module body 302 with respect to the base manifold.

FIG. 7 is an isolated perspective view of an auto-cascade module 330. The auto-cascade module 330 includes a module body 332 having a plurality of storage ports 334, 336 and a base port 338. In FIG. 7, only two storage ports 334, 336 are shown, but additional ports may be used. For example, the module body 332 may have a total of four storage ports. Each of the storage ports 334, 336 is configured to be fluidly connected to the gas supply (not shown). For example, each of the storage ports 334, 336 may receive gas from a separate storage container or a separate bank of storage containers. The base port 338 is configured to fluidly connect to a supply port of the base manifold, such as the supply port 227 (FIG. 3).

The auto-cascade module 330 is configured to automatically switch the supply of the gas that is filling the canister (not shown). For example, the auto-cascade module 330 includes one or more flow-control components (not shown) that determine a pressure of the gas in the storage containers fluidly connected to the different storage ports. By way of example, the storage containers may include Container A, Container B, Container C, and Container D. The gas pressure of each container may increase from Container A to Container D such that Container A has the lowest pressure of all the storage containers and Container D has the highest pressure of all the storage containers. The auto-cascade module 330 identifies that Container A has the lowest pressure and, as such, opens the passage to Container A and closes the passages of Containers B-D so that Container A fills the canister. After the pressure in Container A becomes equal to a designated pressure, such as the pressure of the canister, the auto-cascade module 330 automatically closes the valve to Container A and opens the valve to the container having the next highest pressure (or the second lowest pressure), which is Container B in this example. The auto-cascade module 330 continues to open and close the valves until all of the canisters have been filled or all of the storage containers are depleted.

As shown in FIG. 7, the module body 332 includes a body side 340 having a mating interface 342. The body side 340 is configured to directly engage the base manifold. The mating interface 342 includes the base port 338, which is illustrated as a nozzle 344. The nozzle 344 is configured to be inserted into the supply port of the base manifold. The mating interface 342 may also include other structural features, such as a boss member (not show) or cavities that receive alignment members. In some embodiments, the module body 332 may be secured to the base manifold using a fastener or other mechanism.

FIG. 8 illustrates an isolated perspective view of the manual cascade module 360. The manual cascade module 360 includes a module body 362, a base port 364 coupled to the module body 362, and control valves 373-376 operably coupled to the module body 362. The control valves 373-376 have fixed positions with respect to one another and the manifold body 362. Although not shown, the manual cascade module 360 may include a series of storage ports that receive gas from a respective storage container. The base port 364 is in fluid communication with each of the storage ports through corresponding passages (not shown). Each of the control valves 373-376 is in fluid communication with one of the passages therebetween. For example, the control valve 373 may control the flow of the gas through the passage to a first storage port, the control valve 374 may control the flow of the gas through the passage to a second storage port, the control valve 375 may control the flow of the gas through the passage to a third storage port, and the control valve 376 may control the flow of the gas through the passage to a fourth storage port. A user of the gas-filling system may manually activate each of the control valves 373-376 to open or close the valves. Each of the passages is fluidly connected to a gauge 383-386 that detects a pressure of the corresponding passage. The user may determine when it is necessary to open one valve and close other valves based on the gauges 383-386.

As shown in FIG. 8, the module body 362 includes a body side 366 having a mating interface 368. The body side 366 is configured to directly engage a body side of a base manifold, such as the body side 215 of the base manifold 200 (FIG. 2). The mating interface 368 includes the base port 364, which is illustrated as a nozzle 369. The nozzle 369 is configured to be inserted into the supply port of the base manifold, such as the supply port 223 (FIG. 2). The mating interface 368 may also include other structural features, such as a boss member (not show) or cavities that receive alignment members. The module body 362 also includes a front body side 392 having a control area that includes the gauges 383-386 and user-activated elements 393-396 (e.g., knobs) for the control valves 373-376. The front body side 392 may be added to the front body side of the base manifold, such as the front body side 211, to increase the control area that is presented to the user.

Figure 9:
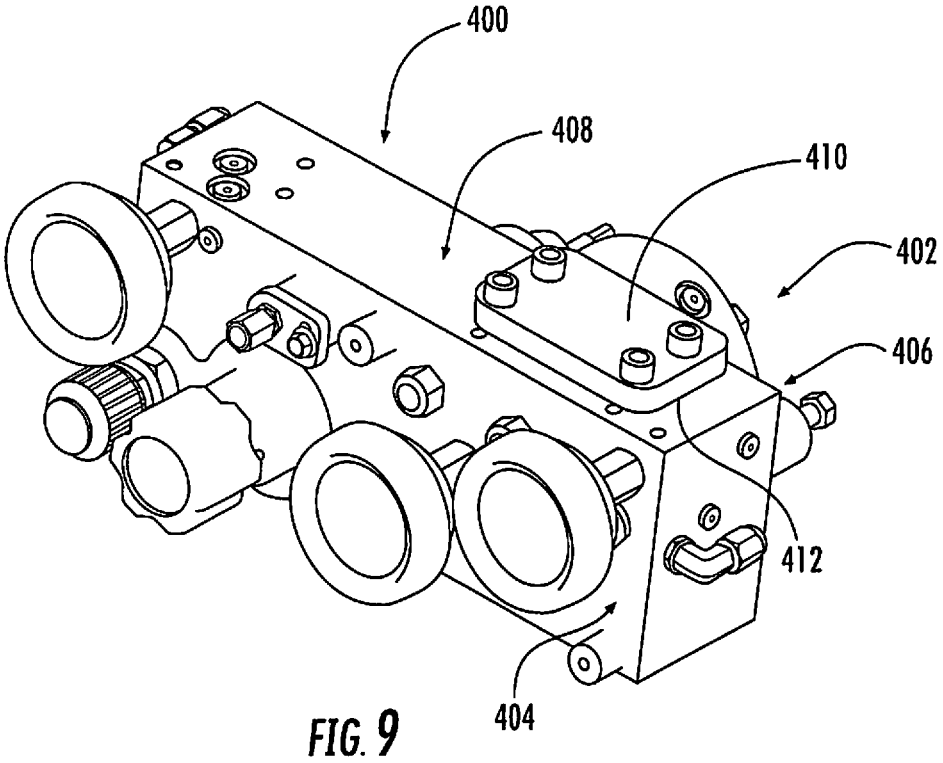
FIG. 9 is a perspective view of a base manifold removably coupled to a bulk storage module in accordance with an embodiment.

FIGS. 9-12 illustrate a base manifold 400 operably coupled to the accessory modules. The base manifold 400 may be similar or identical to the base manifold 200 (FIG. 2). In FIG. 9, the base manifold 400 is operably coupled to the bulk storage module 402, which may be similar or identical to the bulk storage module 300 (FIG. 6). The base manifold 400 has front and back body sides 404, 406 and a top body side 408 that extends between the front and back body sides 404, 406. The front and back body sides 404, 406 face in opposite directions. The bulk storage module 402 is removably coupled to the back body side 404. Also shown in FIG. 9, a sealing component 410 may be secured to the top body side 408. In the illustrated embodiment, the sealing component 410 is a rigid plate, but other sealing components may be used. The sealing component 410 includes a component surface 412 that directly engages the top body side 408 and blocks supply ports, such as the supply ports 225-227 (FIG. 2). As such, gas is directed through the base manifold 400 and the bulk storage module 402.

Figure 10:
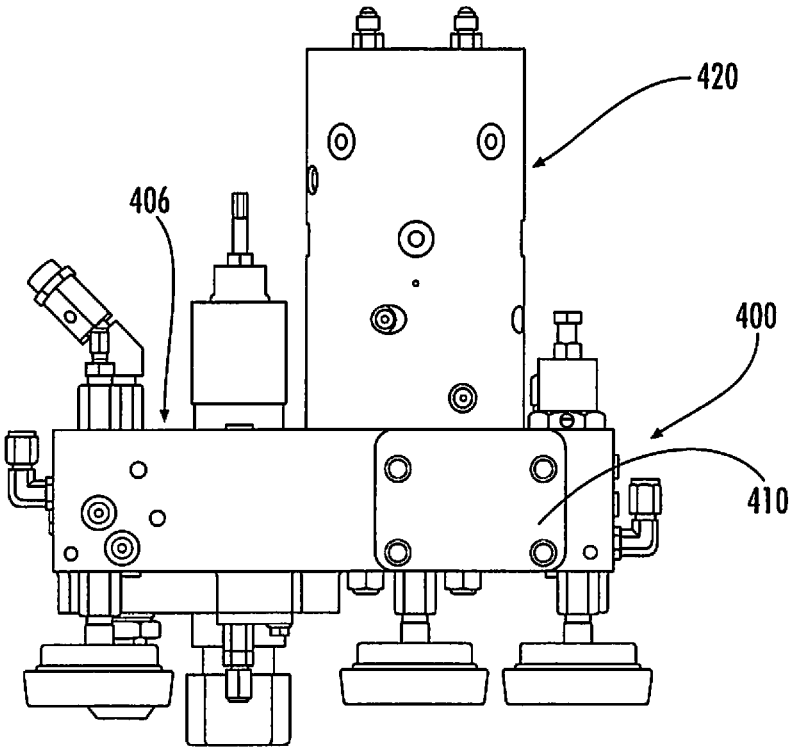
FIG. 10 is a perspective view of a base manifold removably coupled to an auto-cascade module in accordance with an embodiment.

FIG. 10 illustrates the base manifold 400 operably coupled to an auto-cascade module 420, which may be similar or identical to the auto-cascade module 330 (FIG. 7). In FIG. 10, the auto-cascade module 420 is secured to the back body side 406. Similar to FIG. 9, the sealing component 410 is secured to the top body side 408 to block flow of gas through the supply ports.

Figure 12:
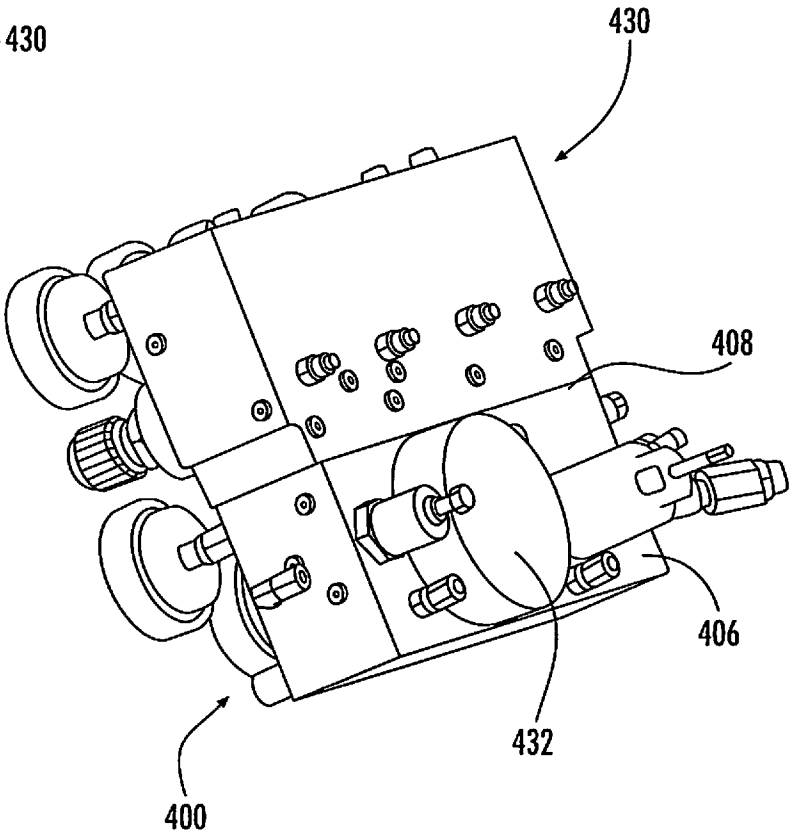
FIG. 12 is a rear perspective view of the base manifold of FIG. 11 removably coupled to the manual cascade module.
Figure 11:
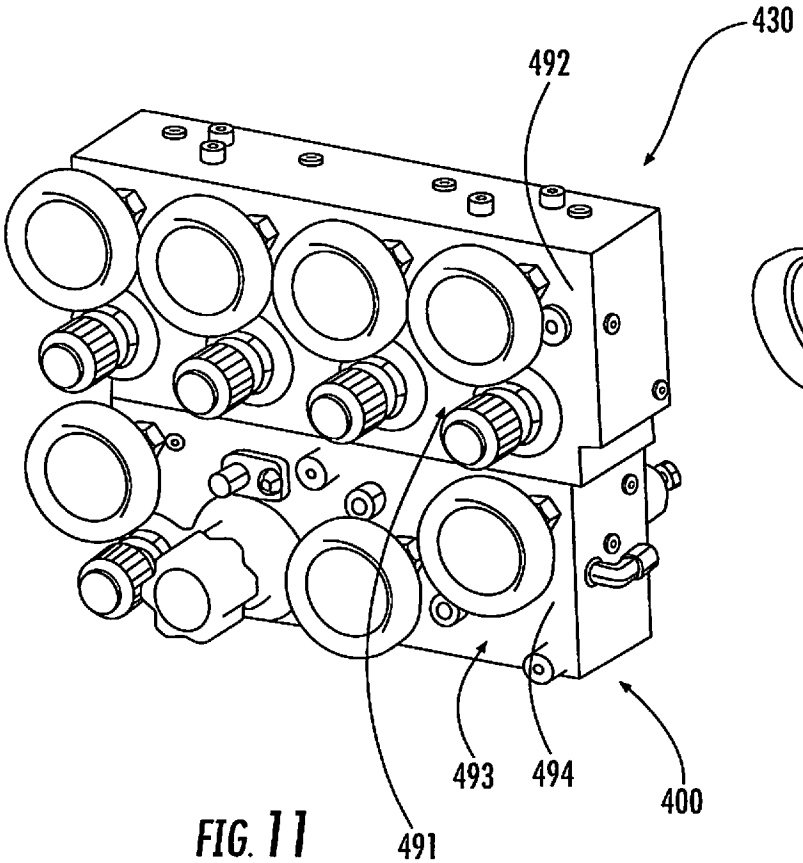
FIG. 11 is a front perspective view of a base manifold removably coupled to a manual cascade module in accordance with an embodiment.

In FIGS. 11 and 12, the base manifold 400 is operably coupled to a manual cascade module 430, which may be similar or identical to the manual cascade module 360 (FIG. 8). As shown, the manual cascade module 430 is secured to the top body side 408. In such embodiments, a sealing component 432 (FIG. 12), which may be similar to the sealing component 410, is secured to the back body side 406. The sealing component 432 may block the supply ports along the back body side 406 so that gas is directed through the base manifold 400 and the manual cascade module 430. Also shown in FIG. 11, a control area 491 of the front body side 492 of the manual cascade module 430 is added to control area 493 of the front body side 494 of the base manifold 400. Accordingly, in some embodiments, the accessory module may add to the control area that is presented to the operator.

Accordingly, embodiments set forth herein include gas-filling systems and base manifolds. At least one technical effect includes the ability to use a common base manifold that is attachable to different accessory modules. The common base manifold includes a pneumatic circuit that is capable of directing different gas inputs through different supply ports to a common fill port. Also, the user or operator may be familiar with the control area of the common base manifold regardless of the accessory module attached to the base manifold. Another technical effect may include the modular assembling of a control system. For example, the base manifold may be stacked with respect to one or more accessory modules. The accessory module may be removably coupled to the base manifold such that it is easier (compared to more complicated gas-filling systems) to add and remove an accessory module to the desired system. Another technical effect may include the capability of attaching multiple flow-control components simultaneously to a base manifold. For example, the manual cascade module may include multiple control valves. Instead of attaching each control valve individually to the control system, all of the control valves are secured to the module body and may be simultaneously attached to the base manifold. It is understood that embodiments set forth herein are not required to achieve each and every technical effect. In some cases, embodiments may achieve only one.

While various spatial and directional terms, such as top, bottom, front, back lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A gas-filling system comprising:

a system housing having a receiving dock that is configured to receive a container for filling the container with a gas;

a base manifold coupled to the system housing, the base manifold comprising a flow-control component and a manifold body that is operably coupled to the flow-control component, the manifold body including a fill port and first and second supply ports that open to an exterior of the base manifold, the first and second supply ports being in fluid communication with a common passage within the manifold body such that the gas flowing through the first supply port or through the second supply port flows through the common passage to the fill port, the flow-control component controlling flow of the gas through the common passage, the fill port configured to be in fluid communication with the container in the receiving dock; and an accessory module removably coupled to the manifold body, the accessory module being connected to the first supply port and having an inlet port, the inlet port being in fluid communication with the first supply port such that the gas flowing through the inlet port flows to the first supply port.

2. The gas-filling system of claim 1, wherein the manifold body includes first and second body sides that face in different directions, the first body side including the first supply port and the second body side including the second supply port.

3. The gas-filling system of claim 2, wherein the manifold body includes a front side having a user-activated element for manually controlling the flow of the gas, the front side and the first side facing in opposite directions, the second side facing in a direction that is perpendicular to the directions faced by the front side and the first side.

4. The gas-filling system of claim 2, wherein the first and second sides have respective side surfaces, the first and second supply ports being substantially flush with the side surfaces of the first and second body sides, respectively.

5. The gas-filling system of claim 1, wherein the manifold body includes a planar side surface, the first supply port being substantially flush with the side surface.

6. The gas-filling system of claim 1, wherein the flow-control component is a first flow-control component and the gas-filling system includes a second flow-control component that controls flow of the gas through the common passage.

7. The gas-filling system of claim 6, wherein the first and second flow-control components are a pressure regulator and a control valve, respectively.

8. The gas-filling system of claim 1, further comprising a sealing component that is secured to the base manifold, the sealing component having a component surface that blocks flow of gas through the second supply port.

9. The gas-filling system of claim 1, wherein the accessory module is configured to control flow of the gas therethrough, the accessory module including an auto-cascade module, a manual cascade module, or a bulk storage module.

10. The gas-filling system of claim 1, wherein the base manifold is configured to control the gas when having a pressure in excess of 5000 pounds per square inch (psi).

* * * * *